US005583906A

United States Patent [19]

Sugiura et al.

[11] Patent Number: 5,583,906

[45] Date of Patent: *Dec. 10, 1996

[54] METHOD OF MANUFACTURING ROTATING ANODE TYPE X-RAY TUBE

[75] Inventors: Hiroyuki Sugiura, Tochigi-ken; Katsuhiro Ono, Utsunomiya; Makoto Tanaka, Otawara, all of Japan

[73] Assignee: Kabushiki Kaisha Toshiba, Japan The term of this patent shall not extend beyond the expiration date of Pat. No.

[21] Appl. No.: 411,875

[22] Filed: Mar. 28, 1995

[30] Foreign Application Priority Data

Apr. 13, 1994 [JP] Japan ..... 6-074695

[51] Int. Cl.[6] ..... H01J 35/10

[52] U.S. Cl. ..... 378/132; 378/144

[58] Field of Search ..... 378/132, 125, 378/131, 133, 144; 73/460, 471, 472

[56] References Cited

U.S. PATENT DOCUMENTS

| | | | |
|---|---|---|---|
| 2,353,150 | 7/1944 | Dietz | 73/472 |
| 3,909,584 | 9/1975 | Brienza et al. | 219/121 |
| 4,688,427 | 8/1987 | Hyland, Jr. | 73/460 |
| 5,204,890 | 4/1993 | Anno et al. | 378/133 |

FOREIGN PATENT DOCUMENTS 9114930 10/1991 WIPO .

OTHER PUBLICATIONS

Patent Abstracts Of Japan, vol. 010, No. 324 (P–512), Nov. 5, 1986 & JP–A0061 130841 (Shimadzu Corp) Jun. 18, 1986.

Patent Abstracts Of Japan, vol. 008, No. 175 (P–294), Aug. 11, 1984 & JP–A–59 068638 (Mitsubishi Jukogyo KK) Apr. 18, 1984.

*Primary Examiner*—David P. Porta

*Attorney, Agent, or Firm*—Cushman Darby & Cushman IP Group of Pillsbury Madison & Sutro, LLP

[57] ABSTRACT

In a method of manufacturing a rotating anode type X-ray tube, in the step of checking the rotational balance of a rotary structure to which an anode target is fixed and correcting the rotational balance as required, the rotary structure is fitted on a stationary support jig which sprays a high-pressure gas from its interior, in place of a columnar stationary structure, to set the rotary structure upright. The rotary structure is rotated at a high speed while spraying the high-pressure gas, and the rotational balance of the rotary structure is checked. The rotational balance of a rotating unit can be checked in the air easily and at high precision, and can be adjusted directly in the outer air as required.

5 Claims, 4 Drawing Sheets

METHOD OF MANUFACTURING ROTATING ANODE TYPE X-RAY TUBE

BACKGROUND OF THE INVENTION

1. Field of the Invention

The present invention relates to a method of manufacturing a rotating anode type X-ray tube and, more particularly, to a method of manufacturing a rotating anode type X-ray tube in which the rotational balance of a rotary structure to which its anode target is fixed is checked and corrected as required.

2. Description of the Related Art

As is known, in a rotating anode type X-ray tube, a disk-type anode target is supported by a rotary structure and a stationary structure that have bearings between themselves and, while the disk-type anode target is rotated at a high speed by energizing a solenoid coil arranged outside a vacuum chamber, an electron beam is emitted from a cathode and bombarded against the surface of the rotating anode target, so that X-rays are emitted from the anode target. Each bearing is constituted by a ball bearing or a hydro-dynamic pressure slide bearing which has a spiral groove formed in its bearing surface and which uses a liquid metal, e.g., gallium (Ga) or a gallium-indium-tin (Ga—In—Sn) alloy, as a lubricant. An example that uses the latter hydro-dynamic pressure slide bearing is disclosed in, e.g., U.S. Pat. No. 4,641,332, U.S. Pat. No. 3,068,885 (Jpn. Pat. Appln. KOKAI Publication No. 60-117531), (Jpn. Pat. Appln. KOKAI Publication No. 2-227948), and U.S. Pat. No. 5,204,890 (Jpn. Pat. Appln. KOKAI Publication No. 5-144396).

An example of a rotating anode type X-ray tube having a hydro-dynamic pressure slide bearing lubricated with a liquid metal has an arrangement as shown in FIGS. 1 to 4. More specifically, in this rotating anode type X-ray tube, a disk-type anode target 11 is coupled to a distal end portion 13*a* of an anode target support shaft 13, which projects from one end of a cylindrical rotary structure 12, with a pin 14*a* and a fixing screw 14*b*. The support shaft 13 is made of a high-melting metal, e.g., molybdenum, and its central portion is hollow in order to decrease heat conduction. A columnar stationary structure 15 is inserted in the cylindrical rotary structure 12, and a flange-type thrust ring 16 is fixed at the lower end portion of the cylindrical rotary structure 12. A lower end portion 15*a* of the columnar stationary structure 15 is hermetically bonded to a cylindrical glass portion 17*a* of a vacuum container or chamber 17 through seal rings 15*b*. The vacuum chamber 17 has a large-diameter metal portion 17*c* having a corona ring 17*b* at the coupling portion with the cylindrical glass portion 17*a*, and surrounding the anode target 11, and an X-ray radiation window 17*d* formed in part of the large-diameter metal portion 17*c*. Note that black coating films (not shown) having a heat emissivity of 0.6 or more are formed on the inner and outer surfaces of the large-diameter metal portion 17*c* of the vacuum chamber 17 in order to effectively dissipate the radiation heat generated by the anode target 11 outside the tube.

A cathode structure 18 is provided to oppose the anode target 11. Two pairs of hydro-dynamic pressure radial slide bearings 19 like those shown in the official gazettes described above, and two pairs of thrust slide bearings 20 are provided in the fitting portions of the cylindrical rotary structure 12 and the columnar stationary structure 15. The two radial slide bearings 19 separated from each other in the direction of the rotation axis have a pair of herringbone pattern spiral grooves 19*a* and a pair of herringbone pattern spiral grooves 19*b* formed in the outer circumferential surface of the stationary structure 15. One of the two thrust slide bearings 20 has a circular herringbone pattern spiral groove 20*a*, as shown in FIG. 3, formed in a stationary structure end face 15*c*. The other thrust slide bearing 20 has a circular herringbone pattern spiral groove 20*b*, as shown in FIG. 4, formed in the upper surface of the thrust ring 16 which is in contact with the stepped surface of the lower portion of the stationary structure 15. The surfaces of the respective slide bearings which are in contact with these spiral groove surfaces are mere smooth surfaces. However, spiral grooves may be formed in these surfaces of the respective slide bearings as required. The bearing surfaces of both the rotary structure 12 and the stationary structure 15 keep a bearing clearance of about 20 μm between themselves during operation.

A lubricant reservoir 21 and a lubricant passage 22 are formed in the stationary structure 15. The lubricant reservoir 21 is formed by boring the central portion of the stationary structure 15 in the axial direction. The lubricant passage 22 is formed in the intermediate portion of the stationary structure 15. The rotary structure 12 has the shaft 13, an iron-alloy intermediate cylinder 23 to which the shaft 13 is fixed, an inner cylinder 24 welded to the lower end portion of the shaft 13, and a copper outer cylinder 25. An insulating clearance 26 having a width of about 0.1 to 1 mm in the radial direction is provided between the inner cylinder 24 whose inner surface serves as a bearing surface and the intermediate cylinder 23 coaxially fitted on the outer circumferential surface of the inner cylinder 24. A liquid metal lubricant (not shown), e.g., a Ga—In—Sn alloy, which liquifies at least during operation is applied to the lubricant reservoir 21, the lubricant passage 22, and the bearing clearance.

The base material of the anode target 11 is made of a high-melting metal, e.g., molybdenum, to constitute an annular heat-accumulating portion 27 having a large volume. An X-ray radiation target layer 28 made of tungsten or a tungsten alloy is formed on a surface of the annular heat-accumulating portion 27 opposing the cathode structure 18. A black coating film 27*a* having a heat emissivity of 0.6 or more is formed on the outer circumferential surface of the annular heat-accumulating portion 27 opposing the large-diameter metal portion 17*c* of the vacuum chamber 17. The distal end portion 13*a* of the support shaft 13 integrally coupled to a rotary structure shoulder portion 12*a* extends through the anode target 11 and is integrally coupled to the anode target 11 with the pin 14*a* and the fixing screw 14*b*, as described above.

To operate this X-ray tube, a drive voltage is supplied to a stator 32, arranged outside the vacuum chamber 17 at a position to correspond to the rotary structure 12 and having a solenoid coil, to generate a rotating magnetic field, thereby rotating the anode target 11 at a high speed. An electron beam is emitted from the cathode structure 18 and bombarded against the target layer 28 of the anode target 11, thereby generating X-rays.

It is needless to say that the rotational balance of a rotating unit obtained by integrally forming the anode target 11 and the rotary structure 12 must be adjusted in advance at high precision. For this purpose, before the rotating unit and the stationary structure 15 are sealed in the vacuum chamber 17, the rotational balance of the rotating unit must be checked. If the rotating unit has an imbalance, for example, part of the anode target 11 is cut off by a predetermined amount, as indicated by reference symbol A in FIG. 1, to adjust the rotational balance, and thereafter the rotating unit is assembled in the vacuum chamber 17. If one cutting operation is not sufficient, the rotational balance is repeatedly checked and corrected.

In a conventionally general structure in which the rotary structure is supported by ball bearings, even when the rotational balance is checked while rotating the rotating unit in the air, a said metal lubricant such as silver or lead for the ball bearings is not substantially degraded. However, in a rotating anode type X-ray tube having a hydro-dynamic pressure bearing as described above that uses a very active liquid metal lubricant, e.g., Ga or a Ga alloy, when the liquid metal lubricant fills a small clearance or the like of the bearing and that between the rotary structure 12 and the stationary structure 15, if the liquid metal lubricant is exposed to air by rotating the rotating unit in the air, the surface of the lubricant itself or the bearing surface wetted with the lubricant oxidizes immediately. When this rotating unit is sealed in a vacuum chamber, a correct bearing performance cannot be obtained. Therefore, a very complicated step of checking and adjusting the rotational balance in a vacuum bell-jar, assembling the rotating unit directly in the vacuum chamber, and the like is needed.

SUMMARY OF THE INVENTION

It is an object of the present invention to provide a method of manufacturing a rotating anode type X-ray tube in which the rotational balance of the rotating unit can be checked in the air easily and at high precision and can be adjusted directly in the air as required.

According to the present invention, there is provided a method of manufacturing a rotating anode type X-ray tube, wherein the step of checking the rotational balance of a rotary structure to which an anode target is fixed and correcting the rotational balance as required, comprises fitting the rotary structure to a stationary support jig which sprays a high-pressure gas from an interior thereof, in place of a stationary structure, rotating the rotary structure at a high speed while spraying the high-pressure gas, and checking the rotational balance.

According to the present invention, there is also provided a method of manufacturing a rotating anode type X-ray tube comprising an anode target, a cylindrical rotary structure to which the anode target is fixed, a stationary structure on which the cylindrical rotary structure fixed with the anode target is rotatably fitted, and a hydro-dynamic pressure slide bearing which is provided between the stationary structure and the rotary structure and to which a liquid metal lubricant is applied, a method of adjusting a rotational balance of the cylindrical rotary structure fixed with the anode target, the adjusting method comprising: the step of fitting the cylindrical rotary structure to a stationary jig from which a high-pressure gas flows; the step of supplying the high-pressure gas into the stationary jig to form a static pressure gas bearing between the cylindrical rotary structure and the stationary jig, thereby floating the cylindrical rotary structure above the stationary jig; the step of applying a rotational force to the cylindrical rotary structure, thereby rotating the cylindrical rotary structure; and the step of checking the rotational balance of the cylindrical rotary structure which is rotating.

According to the present invention, the rotational balance of the rotating unit can be checked in the air easily and at high precision, and can be directly adjusted in the air as required. Therefore, high-precision rotational balance adjustment can be efficiently performed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
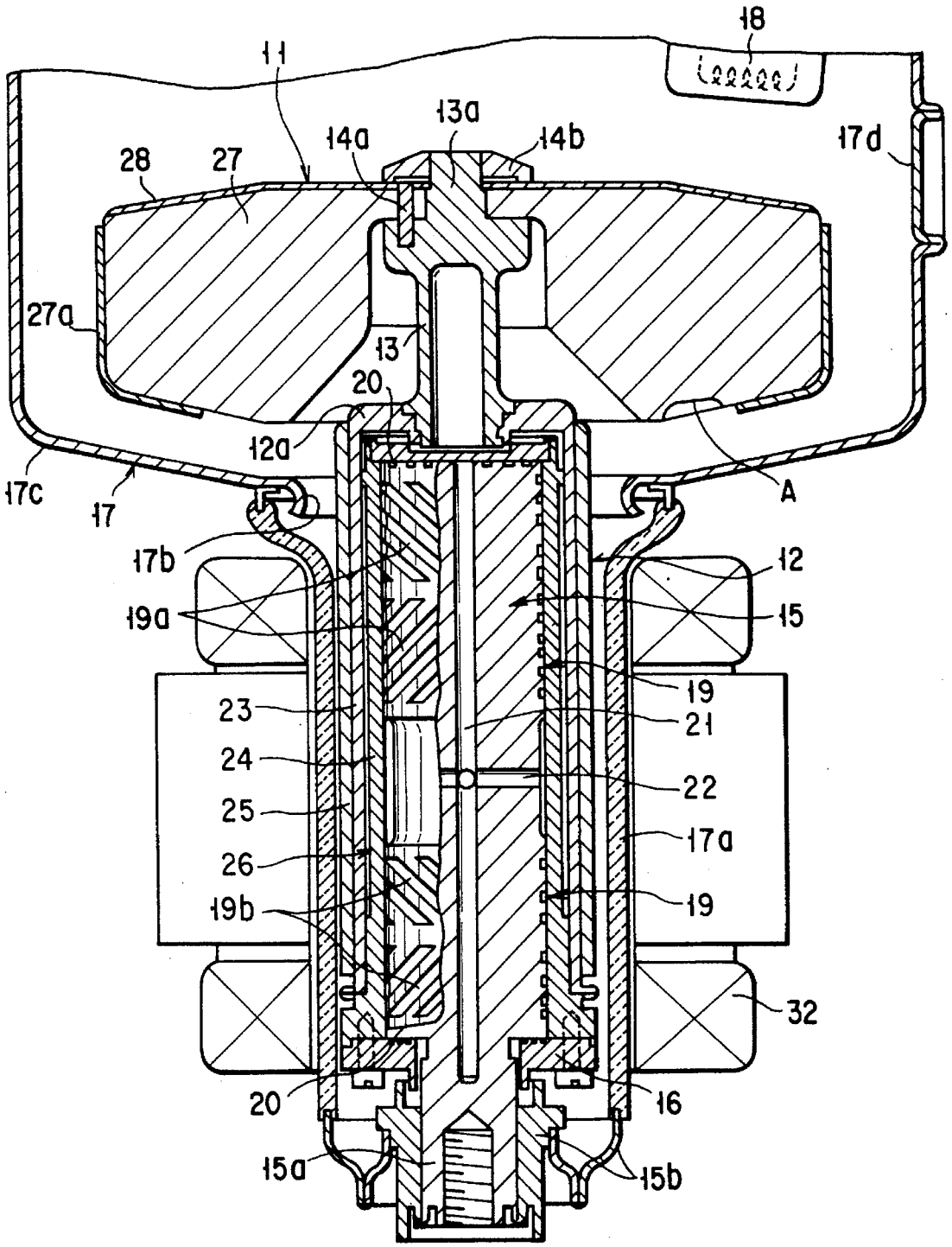
FIG. 1 is a longitudinal sectional view schematically showing a rotating anode type X-ray tube.
Figure 2:
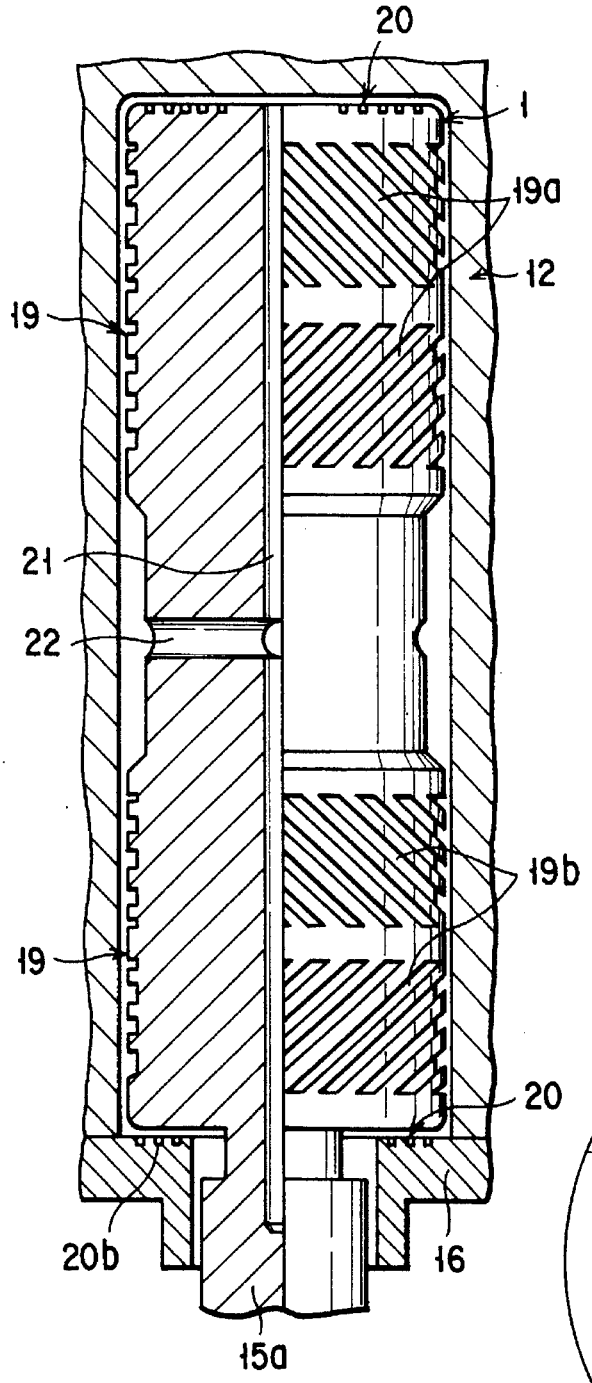
FIG. 2 is a partially enlarged view of FIG. 1.
Figure 3:
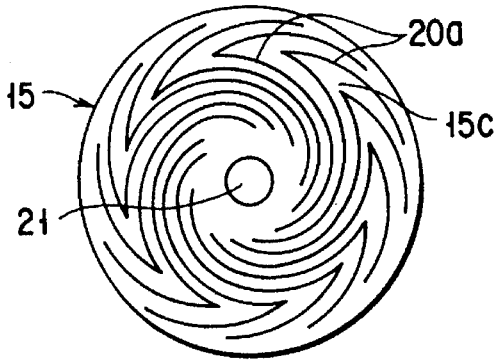
FIG. 3 is a plan view showing part of FIG. 2.
Figure 4:
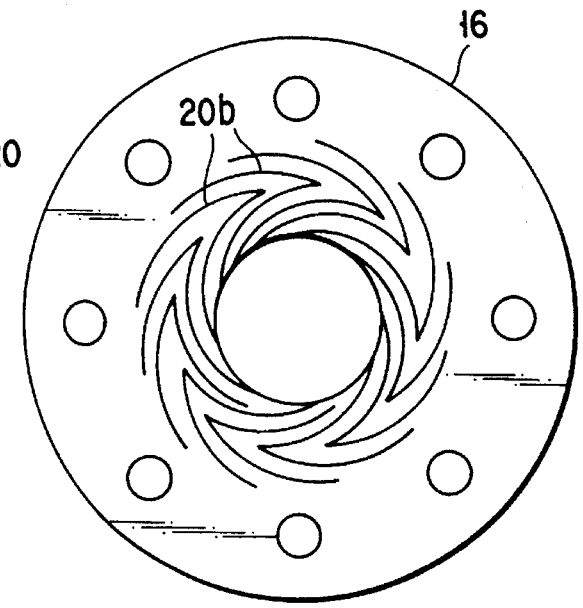
FIG. 4 is a plan view showing part of FIG. 1.
Figure 5:
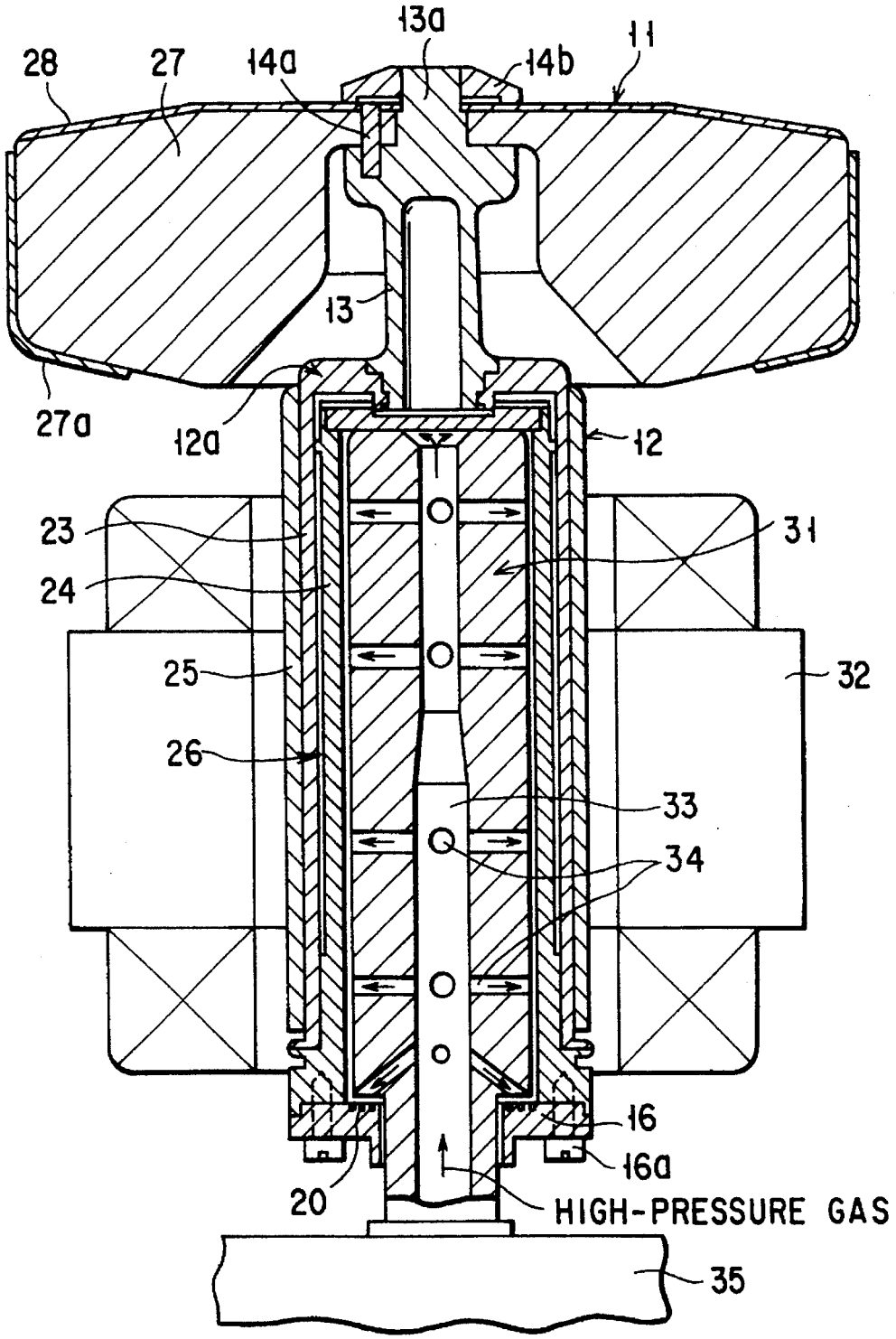
FIG. 5 is a longitudinal sectional view schematically showing a balance adjusting step of the rotating unit in the method of manufacturing a rotating anode type X-ray tube according to the present invention.
Figure 6:
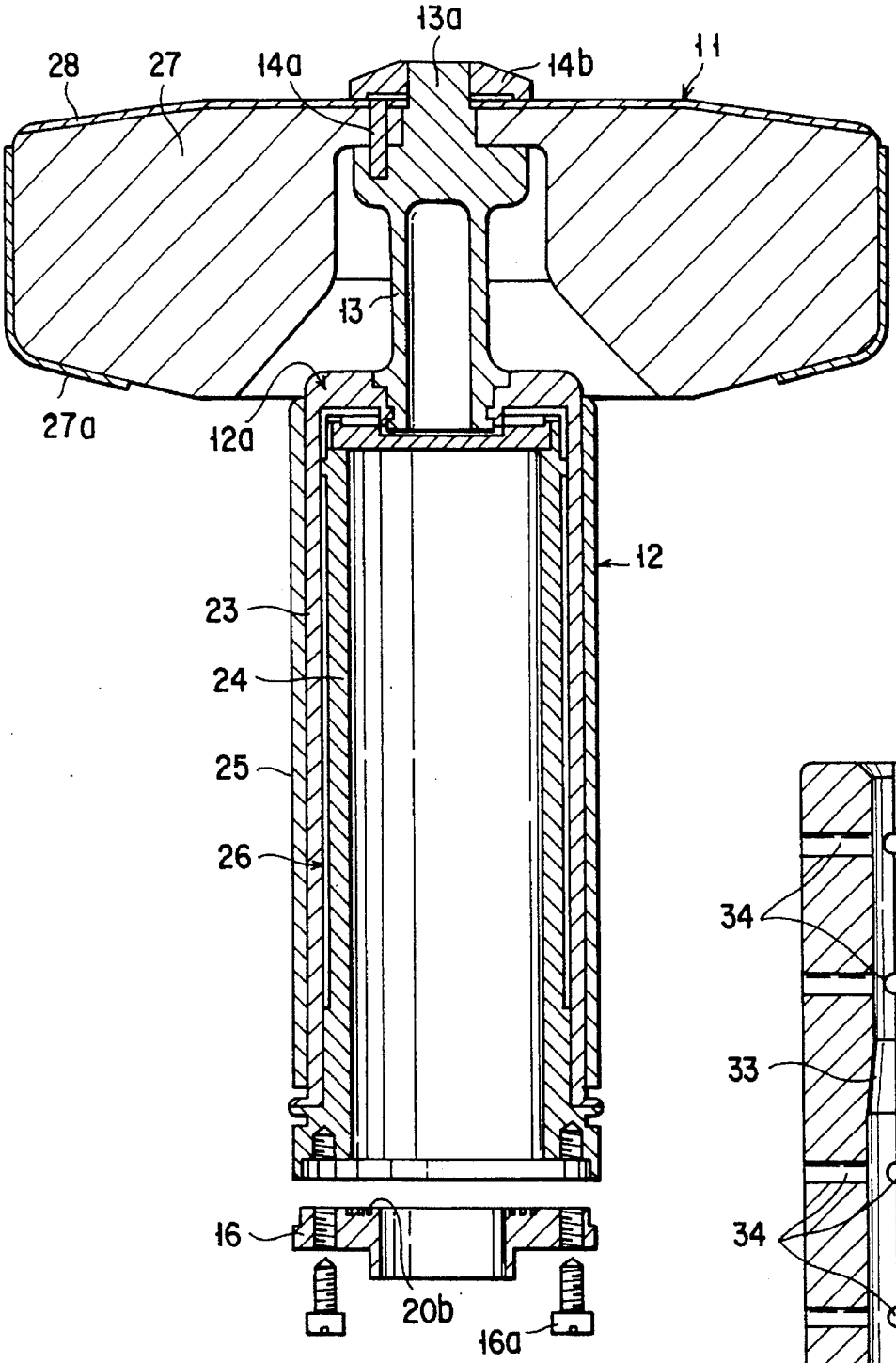
FIG. 6 is a partial longitudinal sectional view of FIG. 5.
Figure 7:
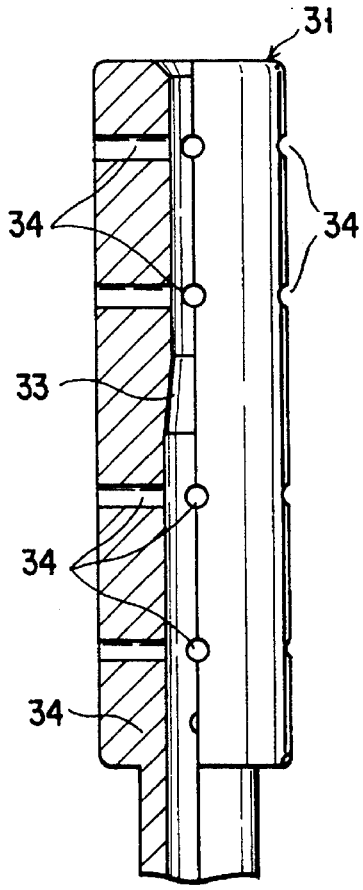
FIG. 7 is a partial longitudinal sectional view of FIG. 5.

A method of manufacturing a rotating anode type X-ray tube according to an embodiment of the present invention will be described with reference to FIGS. 5 to 7. A rotating anode type X-ray tube to which the method of manufacturing a rotating anode type X-ray tube of the present invention is applied has the structure shown in FIGS. 1 to 4, and thus a detailed description thereof will be omitted. In FIGS. 5 to 7, the same reference numerals as in FIGS. 1 to 4 denote the same portions and components. For a detailed description of these same portions and components, refer to the corresponding portion of the above description.

Of the method of manufacturing a rotating anode type X-ray tube, in the step of checking the rotational balance of a rotary structure 12 to which an anode target 11 is fixed and correcting the rotational balance as required, the rotary structure 12 is rotatably fitted on a stationary support jig 31, as shown in FIG. 5. In this state, a high-pressure gas is sprayed from inside the stationary support jig 31 as indicated by an arrow in FIG. 5 to form a substantial static pressure gas bearing between the stationary support jig 31 and the rotary structure 12. The rotary structure 12 floats by the static pressure gas bearing, a stator 32 is energized to rotate the rotating unit, obtained by integrally forming the anode target 11 and the rotary structure 12, at a high speed, and the rotational balance of the rotating unit is checked in the air atmosphere. That is, adjustment of the rotational balance can be performed in the air atmosphere.

Although the stationary support jig 31 has an outer shape and a size similar to those of a columnar stationary structure of a completed X-ray tube, it does not have spiral grooves or the like, and has a ventilation hole 33 with a comparatively large diameter at its central portion and lateral ventilation holes 34 which number four at axially symmetrical positions in the circumferential direction, i.e., separated at angular intervals of 90°, and which number five in the axial direction. This stationary support jig 31 is fixed on a base table 35, and a high-pressure gas is supplied to the internal ventilation holes of the stationary support jig 31 by a compressor (not shown). The high-pressure gas is not limited to air, but an inert gas may be supplied to prevent oxidization of the members constituting the bearings. Since the high-pressure gas is supplied to the small clearance of several 10 μm between the rotary structure 12 and the stationary support jig 31, a substantial static pressure air or gas bearing is constituted between the rotary structure 12 and the stationary support jig 31, thereby rotatably supporting the rotating unit.

To check the rotational balance, the rotating unit obtained by integrally forming the anode target 11 and the rotary structure 12, a thrust ring 16, and bolts 16*a* are prepared, as shown in FIG. 6. The rotating unit obtained by integrally forming the anode target 11 and the rotary structure 12 is fitted on the outer circumferential surface of the substantially cylindrical stationary support jig 31 shown in FIG. 7, and the thrust ring 16 is fixed to the open end portion of the rotary structure 12 with the bolts 16*a*. The stationary support jig 31 assembled in this manner is fixed upright on the base table 35, as shown in FIG. 5, and the rotating unit is held vertically. A high-pressure gas is supplied to the internal ventilation holes of the stationary support jig 31. Thus, the rotating unit is kept floated in both the axial and radial directions. In this state, an ac voltage is applied to the stator 32, so that the rotating unit is rotated by a rotating magnetic field at a required frequency, e.g., 800 r.p.m. The rotational balance is checked by a rotational balance checking unit (not shown). If the rotating unit has an imbalance, rotation is stopped and, e.g., the material at a predetermined position of the anode target 11 is cut off by a predetermined amount, thereby adjusting the rotational balance. If required, checking and correction of the rotational balance are repeatedly performed. After rotational balance adjustment is completed in this manner, the thrust ring 16 is disassembled to remove the rotating unit from the stationary support jig 31. The removed rotating unit is fitted and assembled on a normal stationary structure 15 having spiral grooves and the like, and a liquid metal lubricant is supplied to the bearing portions. The rotating unit is then assembled in a vacuum container. Thereafter, an evacuation step is performed.

The rotational balance can be checked without mounting the thrust ring 16 and the bolts 16*a*. More specifically, since the rotating unit is vertically held, if the lifting force obtained by the high-pressure gas is adjusted appropriately with respect to the weight of the rotating unit, the rotating unit can be caused to float by a predetermined distance and rotated. Thus, the rotating unit can be stably rotated and its rotational balance can be checked without mounting the thrust ring 16 and the bolts 16*a*. Regarding the final rotational balance of the rotating unit, it will not be substantially impaired even if the rotational balance is checked and corrected without mounting the thrust ring 16 and the bolts 16*a*. This is because the ratio of the weight of the thrust ring 16 and the bolts 16*a* to the total weight of the rotating unit is very small. When the thrust ring 16 and the bolts 16*a* are formed at high precision in advance, they will not substantially influence the rotational balance of the rotating unit.

As has been described above, with the method of manufacturing a rotating anode type X-ray tube according to the present invention, the rotational balance of the rotating unit can be checked in the air easily and at high precision, and can be directly adjusted in the air as required. Therefore, high-precision rotational balance adjustment can be performed efficiently.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a rotating anode type X-ray tube comprising an anode target, a cylindrical rotary structure to which said anode target is fixed, a stationary structure on which said cylindrical rotary structure fixed with said anode target is rotatably fitted, a hydro-dynamic pressure slide bearing which is provided between said stationary structure and said rotary structure and to which a liquid metal lubricant is applied, and a vacuum envelope in which the rotary and stationary structures are arranged, said method comprising:

the step of checking a rotational balance of said rotational structure to which said anode target is fixed and correcting the rotational balance if said rotational structure has an imbalance, wherein said rotary structure is fitted on a stationary support jig which sprays a high-pressure gas from an interior thereof, in place of said stationary structure, said rotary structure is rotated while spraying the high-pressure gas, and the rotational balance of said rotary structure is checked;

the step of applying the liquid metal lubricant into the slide bearing between the stationary structure and rotary structure;

locating an assembly of the rotary and stationary structures provided with the liquid metal lubricant in the vacuum envelope; and evacuating the vacuum envelope.

2. In a method of manufacturing a rotating anode type X-ray tube comprising an anode target, a cylindrical rotary structure to which said anode target is fixed, a stationary structure on which said cylindrical rotary structure fixed with said anode target is rotatably fitted, and a hydro-dynamic pressure slide bearing which is provided between said stationary structure and said rotary structure and to which a liquid metal lubricant is applied, a method of adjusting a rotational balance of said cylindrical rotary structure fixed with said anode target, said adjusting method comprising:

the step of fitting said cylindrical rotary structure to a stationary jig from which a high-pressure gas flows;

the step of supplying the high-pressure gas into said stationary jig to form a static pressure gas bearing between said cylindrical rotary structure and said stationary jig, thereby floating said cylindrical rotary structure above said stationary jig;

the step of applying a rotational force to said cylindrical rotary structure, thereby rotating said cylindrical rotary structure; and the step of checking the rotational balance of said cylindrical rotary structure which is rotating.

3. A method according to claim 2, wherein the high-pressure gas is an air flow or an inert gas flow.

4. A method according to claim 2, wherein said adjusting method further comprises:

the step of cutting at least one of said anode target and said cylindrical rotary structure to adjust the rotational balance thereof.

5. A method according to claim 2, wherein said stationary support jig is held vertically and said rotary structure is rotatably fitted on said stationary support jig.

* * * * *

UNITED STATES PATENT AND TRADEMARK OFFICE

CERTIFICATE OF CORRECTION

PATENT NO. : 5,583,906

DATED : DECEMBER 10, 1996

INVENTOR(S) : SUGIURA et al.

It is certified that error appears in the above-indentified patent and that said Letters Patent is hereby corrected as shown below:

TITLE PAGE

"[45] Date of Patent: *Dec. 10, 1996"

should be

--[45] Date of Patent: Dec. 10, 1996--

"[73] Assignee: Kabushiki Kaisha Toshiba, Japan The term of this patent shall not exend beyond the expiration date Pat. No."

should be

--[73] Assignee: Kabushiki Kaisha Toshiba, Japan--

Signed and Sealed this

Thirteenth Day of May, 1997

*Attest:*

*Attesting Officer*

BRUCE LEHMAN

*Commissioner of Patents and Trademarks*